United States Patent [19]

Langguth

[11] 3,986,745

[45] Oct. 19, 1976

[54] GRABBER

[75] Inventor: Arthur F. Langguth, San Diego, Calif.

[73] Assignee: The United States of America as represented by the Secretary of the Navy, Washington, D.C.

[22] Filed: Aug. 25, 1975

[21] Appl. No.: 607,162

[52] U.S. Cl. ..... 294/66 R; 294/86 R; 294/103 R; 114/55

[51] Int. Cl.[2] ..... B66C 1/18

[58] Field of Search ..... 294/66 R, 86 R, 103, 294/113, 118, 81, 119; 214/147 G; 114/51, 55

[56] References Cited

UNITED STATES PATENTS

| | | | |
|---|---|---|---|
| 2,624,611 | 1/1953 | Knapp | 294/103 |
| 3,722,941 | 3/1973 | Seiple et al. | 294/66 R |
| 3,733,101 | 5/1973 | Sayre, Jr. | 294/66 R |

*Primary Examiner*—James B. Marber
*Attorney, Agent, or Firm*—Richard S. Sciascia; Ervin F. Johnston; Thomas Glenn Keough

[57] ABSTRACT

This device assures the underwater recovery of heavy objects by marine mammals. A trigger mechanism releases sections of spring biased tubing which converged about the object. After the tubing sections interconnect, the marine mammal pulls free and the object is retrieved by a hoisting line. If the object is partially buried in marine sediment, a pair of pressurized gas cartridges are ruptured to jet a pathway for the converging tubular sections. Because the tubing sections are inherently strong, the hoisting line optionally is connected directly to them or to a suitably arranged bridle. The lightweight concentrically arranged tubing sections are capable of lifting heavy loads and are designed to assure reliable trouble free operation.

19 Claims, 8 Drawing Figures

GRABBER

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

There are a wide variety of ice-tong-like retrievers or lifting slings which reach around or otherwise grip an object for transporting it from one place to another. While most of these devices are satisfactory in warehouses, factories, etc., the retrieval of objects underwater limits their reliability. Now that marine mammals have been trained to locate and retrieve submerged objects, most contemporary grabbers are simply too unmanagable for the animals. One somewhat acceptable design is disclosed in U.S. Pat. No. 3,722,941 issued to Ronald L. Seiple and entitled "Marine Mammal Underwater Attachment and Recovery Tool". This tool is lightweight enough to be carried by a marine mammal, yet is capable of recovering only relatively lightweight ordnance because the mechanism tended to become sprung or would not align properly if not perfectly placed. Marine sediment would jam it and it was incapable of recovering ordnance partially buried in ocean floor. Thus, there is a continuing need in the state of the art for a reliable, heavy duty device for recovering objects underwater which is light enough to be carried by a marine mammal.

SUMMARY OF THE INVENTION

The present invention is directed to providing an apparatus for engaging an object underwater. Two arcuate members each have an arcuately shaped outer element and an arcuately shaped inner element each sized to be concentrically carried inside of an outer element and partially coextensively contained within it. Means hold the inner elements inside of the outer elements and overcome the biasing force exerted by a pair of helically shaped springs. A trigger means contacts the object to be recovered to retracts the holding means. The two spring biased inner elements are released to extend themselves in a converging, gripping position about the object.

It is an object of this invention to provide an improved retriever of underwater ordnance.

Another object of the invention is to provide a retriever of underwater ordnance which is lightweight enough to be deployed by a marine mammal.

Another object of the invention is to provide a lightweight underwater retriever which provides an increased lift capability.

Yet another object is to provide an underwater grabber which is constructed to ensure higher reliability.

Still another object is to provide a retriever which optionally is used to lift an object or is used to connect a hoisting bridle.

Another object is to provide a recovery device which is securable to an object partially buried in sediment.

Still another object is to provide a retriever having a jetting capability for burrowing through sediment around a partially buried object.

These and other objects of the invention will become more readily apparent from the ensuing specification when taken together with the drawings.

DESCRIPTION OF THE PREFERRED EMBODIMENTS

Figure 1:
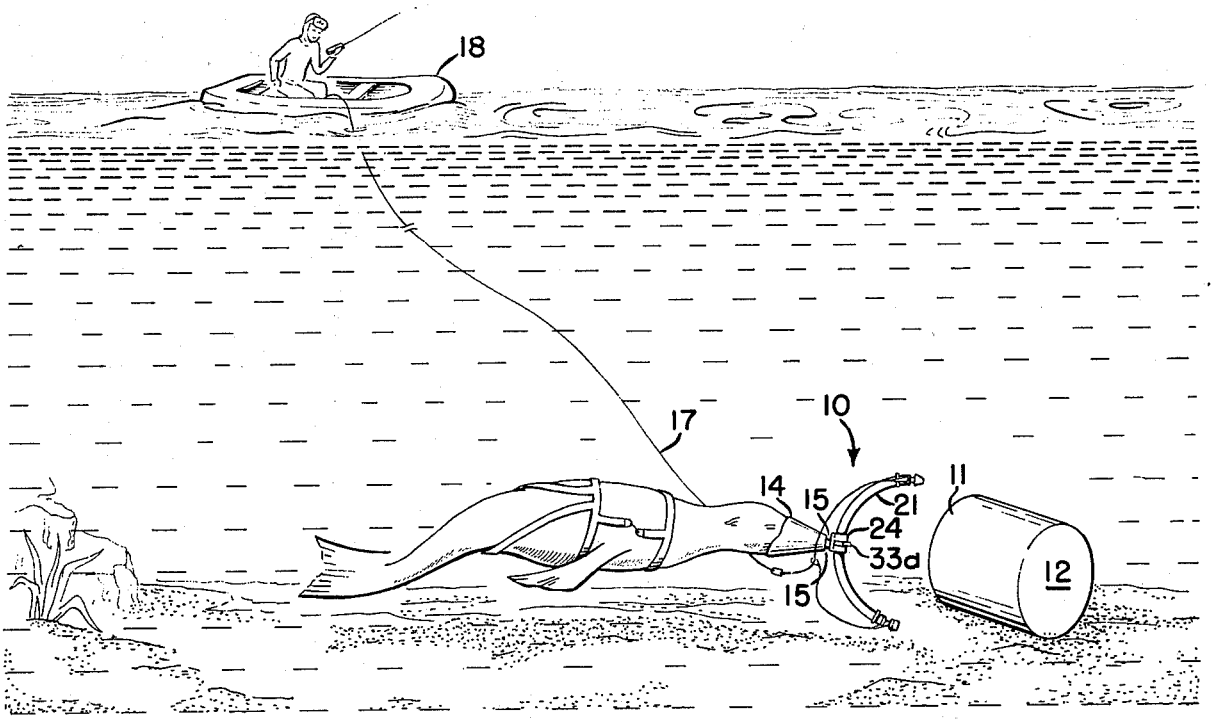
FIG. 1 is an isometric depiction of the invention during deployment.

Referring now to the drawings, and in particular, to FIG. 1, an improved grabber 10 is about to be placed against a curved surface 11 of a sunken object 12. Because of its compact size and arrangement, to be elaborated on below, the grabber is easily deployed by a sea lion carrying it on a fitted nose cup 14.

The nose cup is shaped to be held on the animal's face when its jaws are held partially open so that when the grabber engages the target, the animal can pull free and return to the surface. Optionally, a mouthpiece is substituted, but in either event connection is made to the grabber via a pair of bolts 15. After engagement, a hoisting line 17 reaching to a surface craft 18 allows a handler or crewman to retrieve the object.

Figure 2:
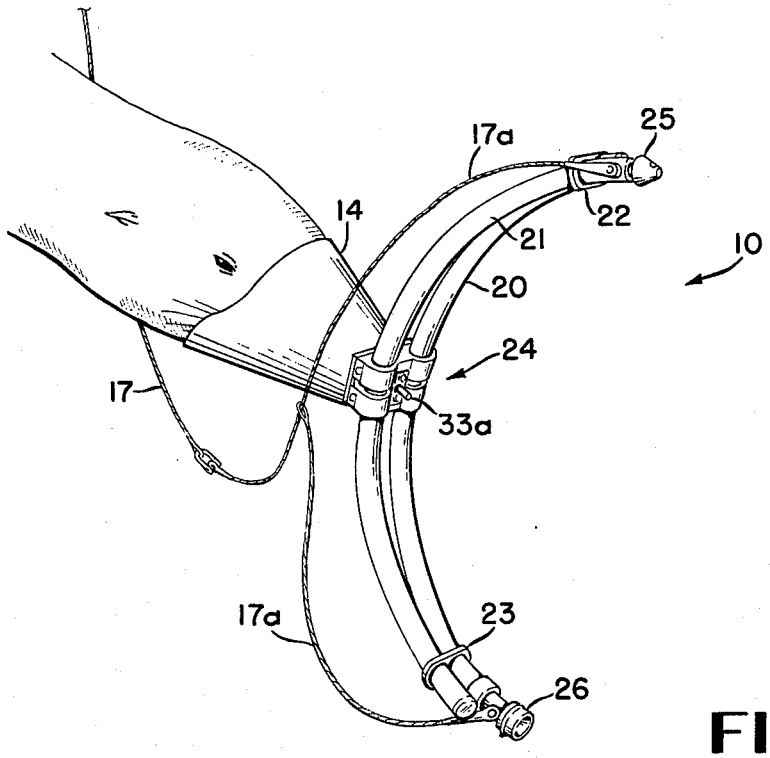
FIG. 2 is an isometric view of the invention as it is carried by the marine mammal.

FIG. 2 shows a somewhat more detailed view of the improved grabber as it is being carried by a sea lion to an undersea target. A pair of arcuate members or sections 20 and 21 are held alongside one another by retainers 22 and 23 and a trigger mechanism 24.

Figure 3:
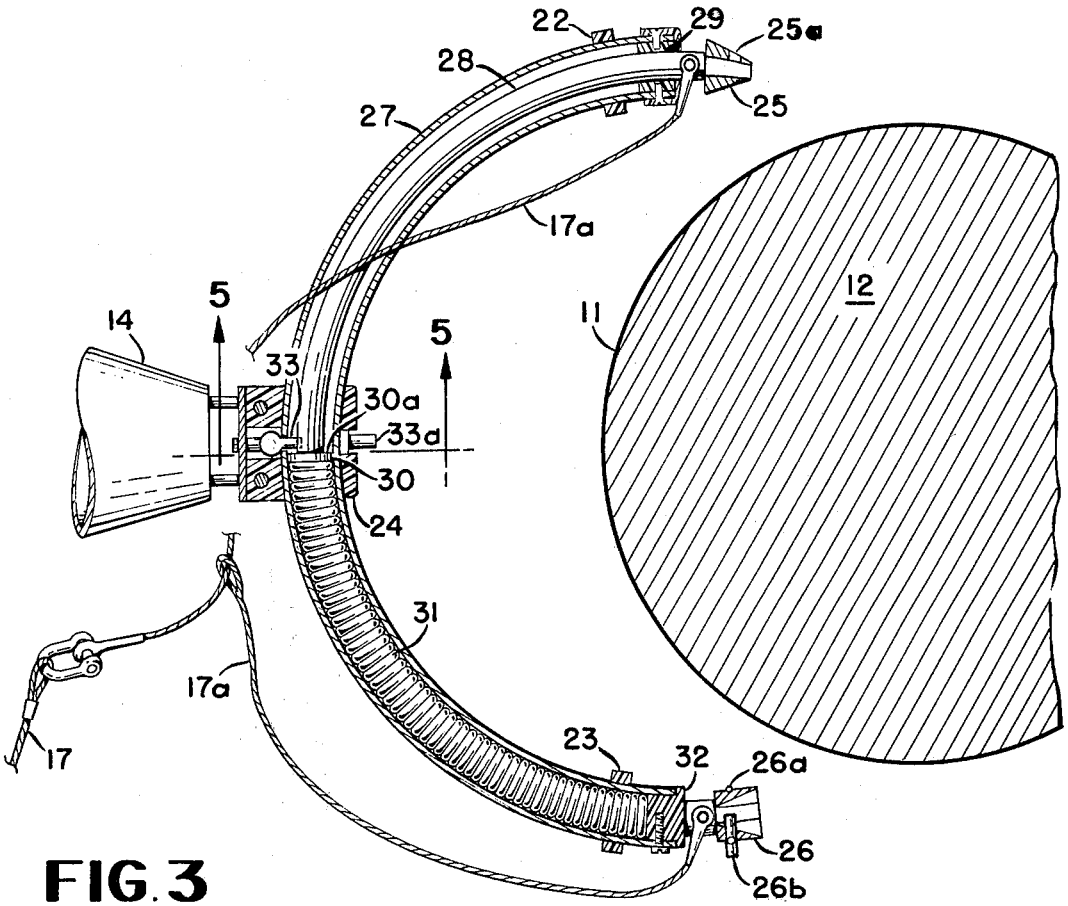
FIG. 3 is a side view partially in cross section of the invention in the cocked position.
Figure 4:
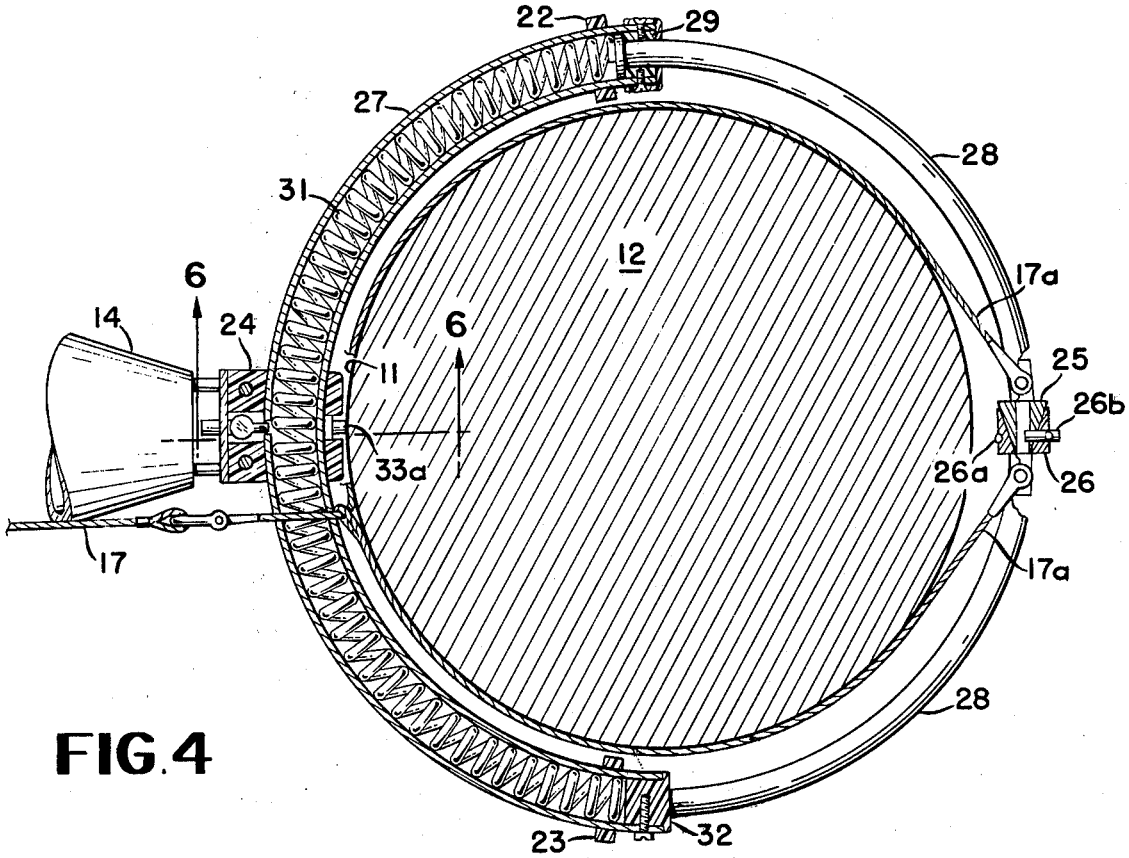
FIG. 4 shows the embodiment of FIG. 3 in the locked position.

On the opposite ends of the arcuate members mating portions 25 and 26 of a latch are disposed to ensure a positive engagement about an object to be recovered. A recess **25*a* is provided in cone shaped latch portion 25 and when it is pushed into cup shaped latch portion 26, it overcomes the biasing force of annular spring 26*a*. This permits a spur 26*b* to snap into the recess and connect the latching portions together, see FIGS. 3 and 4. and 4.**

The retrieval or hoisting line 17 is secured to the two latch portions and optionally forms a bridle **17*a*** which is free to slide and accommodate the object. Having the bridle coupled directly to the latch portions shunts lifting stresses from the arcuate members and allows for the recovery of heavier loads.

Both arcuate members include an outer section of tubing 27 and an inner section of tubing 28. The two sections of tubing are sized and shaped relative to each other to allow the free extension of the inner section from the outer section. The inner sections of tubing have a length corresponding to approximately one-quarter of a complete circle, so that when they are fully extended from the outer sections they converge about the object to be recovered. At this point it should be pointed out that retainers 22 and 23 and trigger mechanism 24 are dimensioned and arranged to ensure that latch portions 25 and 26 will come together and engage when the inner sections of tubing are fully extended.

To facilitate a smooth, trouble-free extension of the inner sections, guide bushings 29 are provided at the outer ends of both the outer sections of tubing and the inner ends of each of the inner sections of the tubing are shaped with a suitably sized flange 30 to ensure smooth outward travel. The flanges also serve to engage trigger mechanism 24, as will be explained below.

A helical compressed spring 31 is carried inside of each of the outer sections of tubing and exerts an oppositely directed force between a flange and a butt portion 32. Each spring is of such a length that it is capable of being compressed within the quarter circle arc when the inner sections are in the cocked or retracted position and for fully extending the inner sections from the outer sections of tubing to engage the mating latch portions 25 and 26.

Figure 5:
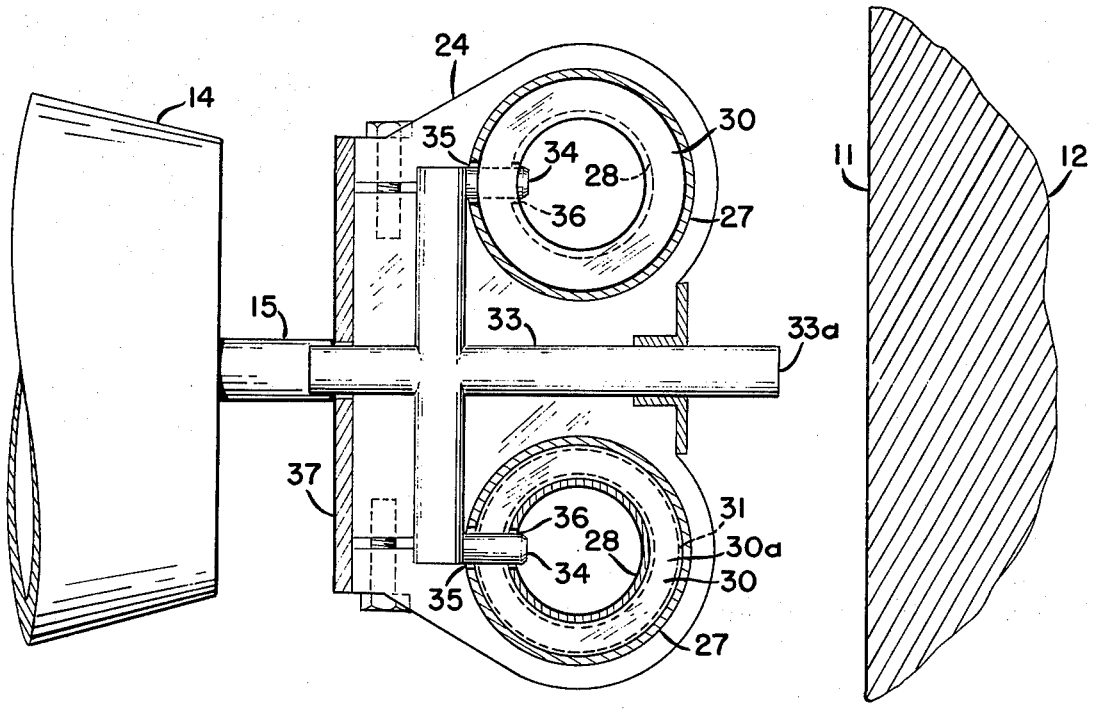
FIG. 5 is a cross-sectional view of the trigger mechanism taken generally along lines 5—5 in FIG. 3.
Figure 6:
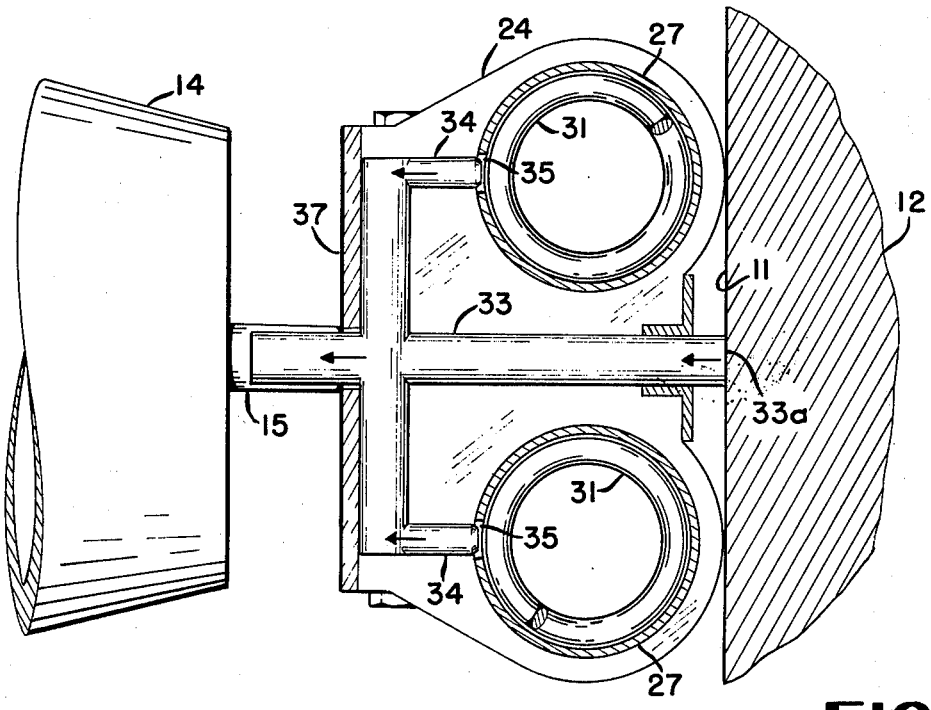
FIG. 6 is a cross-sectional view of the trigger mechanism taken generally along lines 6—6 in FIG. 4.

Reliable release of both inner sections of tubing 28 about the object is ensured by trigger mechanism 24. Referring ahead to FIGS. 5 and 6, the mechanism includes an essentially T-shaped member 33 having a pair of sear elements 34. The sear elements reach through appropriately disposed openings 35 in outer sections of tubing 27 and abut surfaces 30*a* on each flange 30 and thereby retain the inner sections of tubing in a cocked position. If desired, the sears extend past surfaces 30*a* into holes 36 drilled into the inner sections of tubing.

An exposed stem 33*a* of the T-shaped member extends beyond the trigger mechanism and is so located to release the inner sections of tubing. As a marine mammal approaches a sunken object, see FIGS. 3 and 5, the exposed stem holds the grabber cocked, yet as it contacts the surface it remains relatively stationary while the rest of the grabber continues toward the object. Sears 34 are pulled from the path of flanges 30*a* and holes 36. The two inner sections of tubing are pushed toward converging positions by their associated helical springs 31. The mating latch portions 25 and 26 engage and the object is secured for retrieval by the hoisting line and its bridle, as outlined above. After retrieval, the grabber is connected to another hoisting line, recocked, and reused. A retainer plate 37 is included to avoid losing the T-shaped member.

The aforedescribed grabber has successfully demonstrated its capability to fix hoisting cables for recovering objects weighing as much as 3,000 pounds. Cylindrically shaped objects resting on one end or the other are engagable by the aforedescribed grabber where at least a portion of its total rounded contour 11 is exposed.

Figure 7:
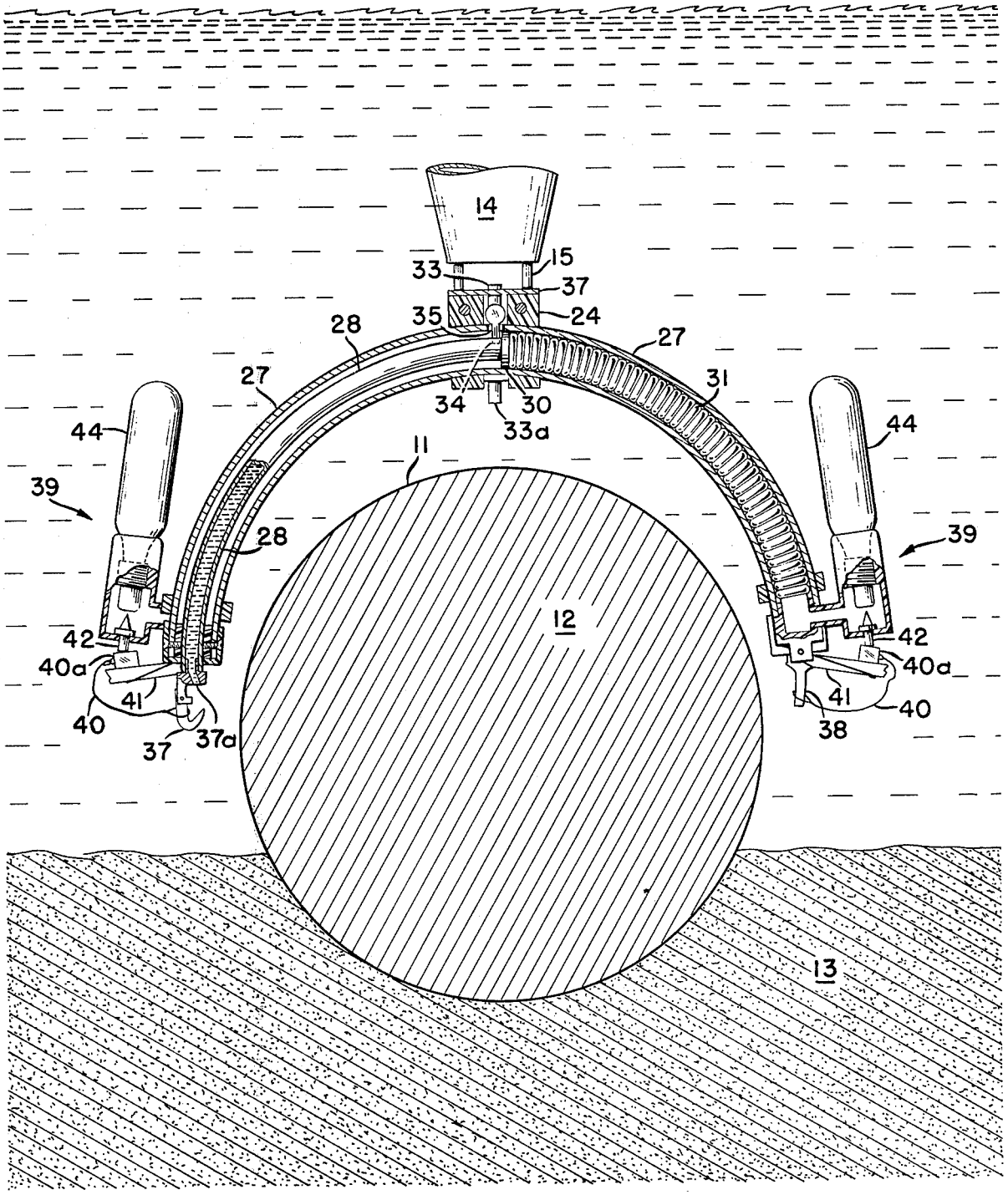
FIG. 7 depicts the invention in the cocked position and having a jetting capability.
Figure 8:
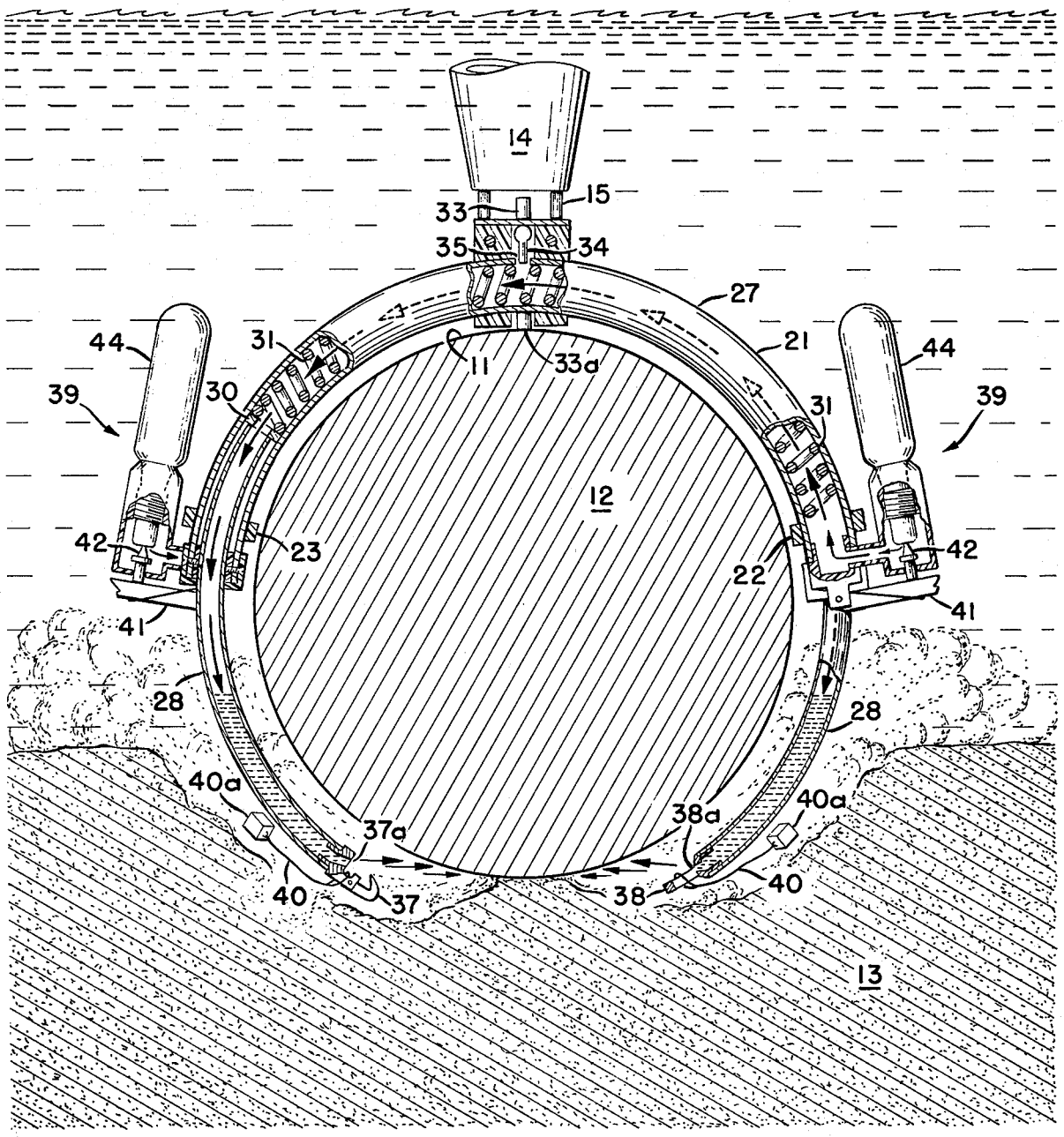
FIG. 8 shows the jetting version of the invention in the locked position.

A semiburied object poses no problems for the embodiment schematically depicted in FIGS. 7 and 8. In this embodiment, like elements have been given identical reference characters. A modified hook and eye latch 37 and 38 has been substituted and a pair of jetting mechanisms 39 have been added.

Noting FIG. 7, object 12 is partially buried in sediment 13 and as the marine mammal pushes down, exposed stem 33*a* releases the inner sections of tubing 28. The two inner sections of tubing 28 spring toward extended converging positions about the object, as outlined above, and lanyards 40 attached to the hook and eye latch yank at a pair of retainers 40*a*.

This pulls them from between a spring biased snap 41 and a firing pin 42 of each gas jetting mechanism 39. The firing pins rupture pressurized gas cartridges 44 and pressurized gas is vented to the inside of both arcuate members 20 and 21.

Pressurized gas rushes toward openings 37*a* and 38*a* in the hook and eye latch. Water, heretofore entrained in the arcuate members is blown out through the openings ahead of the pressurized gas. The jetting action of the water blows sediment from the path of the converging inner sections of tubing 28. The vented gas follows to clear a path although it has been found that the entrained water does most of the clearing. Engagement between the hook and eye thusly is not impaired. Retrieval of the object is made by a hoisting line as outlined above. The hoisting line is not shown in FIGS. 7 and 8 of the drawings to avoid unnecessary detail.

Since all the aforedescribed elements must function reliably in a corrosive marine environment, they are all fabricated from noncorrosive, or at least, corrosion resistant materials. Stainless steel has been found to be acceptable although a more reactive metal may be suitable where other considerations predominate.

Obviously, many modifications and variations of the present invention are possible in the light of the above teachings, and, it is therefore understood that the present invention may be practiced otherwise than as specifically described.

What is claimed is:

1. An apparatus for engaging an object comprising:

means for defining two arcuate members each member having an arcuately shaped outer element and an arcuately shaped inner element sized to be concentrically carried inside of an outer element and being partially coextensively contained therein;

means connected to both arcuate members for holding the inner elements in the outer elements;

means sized to be contained in each of the outer elements and bearing against inner first ends of each of the inner elements for urging them from their positions of being partially coextensively contained in the outer elements; and means coupled to the holding means for displacing it to release the inner elements to extended converging positions about the object.

2. An apparatus according to claim 1 further including:

means carried on exposed second ends of the inner elements for securing them together about the object.

3. An apparatus according to claim 2 further including:

means coupled to the defining means for positioning it adjacent the object to effect its engagement.

4. An apparatus according to claim 3 further including:

means coupled to the securing means for permitting the retrieval of an engaged object.

5. An apparatus according to claim 4 in which the arcuate members are arranged in a side by side relationship and the arcuately shaped inner and outer elements are semicircular lengths of tubing.

6. An apparatus according to claim 5 further including:

means connected to both arcuate members for orientating the inner and outer elements to ensure that they extend to converging positions about the object.

7. An apparatus according to claim 6 in which the urging means is a pair of helically extending springs exerting angularly opposed forces.

8. An apparatus according to claim 7 in which the securing means includes a spring biased latch portion on one of the second ends of the inner elements and a suitably configured mating surface on the other one of the second ends of the inner elements to further ensure the securing about the object.

9. An apparatus for engaging an object comprising:

means for defining two arcuate members arranged in a side by side relationship each member having an arcuately shaped outer element formed from a semicircular length of tubing and an arcuately shaped inner element formed from a semicircular length of tubing and sized to be concentrically carried inside of an outer element and being partially coextensively contained therein, annular guides are provided between the inner and outer elements in both arcuate members to permit smoother operation;

means connected to both arcuate members for orientating the inner and outer elements to ensure that they extend to converging positions about the object;

means coupled to the defining means for positioning it adjacent the object to effect its engagement;

means connected to both arcuate members for holding the inner elements in the outer elements;

a helically extending spring exerting an angularly opposed force contained in each of the outer elements and bearing against inner first ends of each of the inner elements for urging them from their positions of being partially coextensively contained in the outer elements;

means coupled to the holding means for displacing it to release the inner elements to extended converging positions about the object;

means carried on exposed second ends of the inner elements for securing them together about the object; and means coupled to the securing means for permitting the retrieval of an engaged object.

10. An apparatus for engaging an object comprising:

means for defining two arcuate members each member having an arcuately shaped outer element and an arcuately shaped inner element sized to be concentrically carried inside of an outer element and being partially coextensively contained therein;

means coupled to the defining means for positioning it adjacent the object to effect its engagement;

means connected to both arcuate members for holding the inner elements in the outer elements;

means contained in each of the outer elements and bearing against inner first ends of each of the inner elements for urging them from their positions of being partially coextensively contained in the outer elements;

means coupled to the holding means for displacing it to release the inner elements to extended converging positions about the object;

means carried on exposed second ends of the inner elements for securing them together about the object;

means coupled to the securing means for permitting the retrieval of an engaged object; and means coupled to the defining means for jetting away sediment as the inner elements move toward their extended converging positions about the object.

11. An apparatus according to claim 10 in which the jetting means includes at least one source of pressurized gas in fluid communication with the inside of each inner element and at least one opening on each exposed second end of each inner element for jetting fluid therethrough.

12. An apparatus according to claim 11 in which the jetting means additionally includes an actuation mechanism operatively associated with each pressurized gas source for releasing the pressurized gas therefrom.

13. An apparatus according to claim 12 in which the jetting means additionally includes a lanyard connected to each inner element and each actuation mechanism for actuating same when each inner element extends to a predetermined converging position about the object.

14. An apparatus according to claim 13 in which the jetted fluid is liquid displaced from the inside of each inner element by pressurized gas for jetting away sediment.

15. An apparatus according to claim 9 further including:

means coupled to the defining means for jetting away sediment as the inner elements move toward their extended converging positions about the object.

16. An apparatus according to claim 10 in which the jetting means includes at least one source of pressurized gas in fluid communication with the inside of each inner element and at least one opening on each exposed second end of each inner element for jetting fluid therethrough.

17. An apparatus according to claim 16 in which the jetting means additionally includes an actuation mechanism operatively associated with each pressurized gas source for releasing the pressurized gas therefrom.

18. An apparatus according to claim 17 in which the jetting means additionally includes a lanyard connected to each inner element and each actuation mechanism for actuating same when each inner element extends to a predetermined converging position about the object.

19. An apparatus according to claim 18 in which the jetted fluid is liquid displaced from the inside of each inner element by pressurized gas for jetting away sediment.

* * * * *